US005868205A

United States Patent [19]

Cunningham et al.

[11] Patent Number: 5,868,205

[45] Date of Patent: Feb. 9, 1999

[54] SELF-CONTAINED AUTOMATIC FIRE EXTINGUISHER

[75] Inventors: James Cunningham, Bellrose, N.Y.; Carl Greenfield, Freehold, N.J.; Theordore Kahn, Woodmere, N.Y.

[73] Assignee: Fail Safe Safety Systems, Inc., New York, N.Y.

[21] Appl. No.: 807,520

[22] Filed: Feb. 27, 1997

[51] Int. Cl.[6] ..... A62C 3/00

[52] U.S. Cl. ..... 169/65; 169/26

[58] Field of Search ..... 169/65, 26, 42, 169/90

[56] References Cited

U.S. PATENT DOCUMENTS

| | | | |
|---|---|---|---|
| Re. 29,155 | 3/1977 | Mears et al. . | |
| 2,293,366 | 8/1942 | Solosko | 169/26 |
| 2,674,324 | 4/1954 | Mascarini | 169/26 |
| 3,132,695 | 5/1964 | Peltier | 169/26 |
| 3,221,995 | 12/1965 | Sievert . | |
| 3,245,474 | 4/1966 | Romero . | |
| 3,356,148 | 12/1967 | Jamison . | |
| 3,407,880 | 10/1968 | Davis . | |
| 3,446,286 | 5/1969 | Kreidler . | |
| 3,517,746 | 6/1970 | Balmes, Jr. . | |
| 3,653,443 | 4/1972 | Dockery . | |
| 3,710,855 | 1/1973 | Osorio . | |
| 3,773,111 | 11/1973 | Dunn | 169/65 |
| 3,866,687 | 2/1975 | Banner . | |
| 3,884,306 | 5/1975 | Williams . | |
| 3,897,828 | 8/1975 | Glover . | |
| 3,918,526 | 11/1975 | Hattori et al. . | |
| 4,113,020 | 9/1978 | Panetta . | |
| 4,256,181 | 3/1981 | Searcy . | |
| 4,299,289 | 11/1981 | Kato | 169/26 |
| 4,553,602 | 11/1985 | Pieczykolan | 169/90 |
| 4,763,731 | 8/1988 | Adams et al. . | |
| 4,813,487 | 3/1989 | Mikulec et al. . | |
| 4,830,114 | 5/1989 | Jessick et al. . | |
| 4,830,116 | 5/1989 | Walden et al. . | |
| 4,979,572 | 12/1990 | Mikulec . | |
| 5,127,479 | 7/1992 | Stehling et al. . | |
| 5,186,260 | 2/1993 | Scofield . | |
| 5,291,952 | 3/1994 | Arend . | |
| 5,297,636 | 3/1994 | North . | |
| 5,355,026 | 10/1994 | Scofield . | |
| 5,441,113 | 8/1995 | Pierce . | |

FOREIGN PATENT DOCUMENTS

| | | | |
|---|---|---|---|
| 58298 | 5/1977 | Japan | 169/90 |

*Primary Examiner*—Gary C. Hoge

*Attorney, Agent, or Firm*—Frishauf, Holtz, Goodman, Langer & Chick, P.C.

[57] ABSTRACT

A self-contained automatic fire extinguishing device includes a container having container walls defining a container chamber for storage of a fire extinguishing agent therein. The container has at least one aperture through its container walls. The fire extinguishing device also includes a vessel having vessel walls defining a vessel chamber. The vessel is coupled to the container such that the container chamber is in fluid communication with the vessel chamber via the at least one aperture. The vessel also has at least one opening therethrough. A heat responsive closure/actuating element is coupled to the container for substantially selectably sealing the at least one aperture of the container to alternately prevent and permit fluid communication between the container chamber and the vessel chamber.

14 Claims, 3 Drawing Sheets

SELF-CONTAINED AUTOMATIC FIRE EXTINGUISHER

BACKGROUND OF THE INVENTION

1. Field of the Invention

The present invention relates to fire extinguishers, and more particularly relates to an automatically operated fire extinguisher for use with a cooking device such as a kitchen range or stove.

2. Description of the Related Art

The use of automatically activated fire extinguishing devices for kitchen ranges and the like is known. Such devices typically disperse fire extinguishing compound onto a cooking device when a fire is detected. The prior art devices, however, are relatively bulky. In addition, the prior art automatic fire extinguishing devices generally store the fire extinguishing compound in a container which is at a location remote from where the agent is dispersed. The fire extinguishing compound is typically transported from the storage container through a piping arrangement to a spraying device (located above the cooking surface) for dispersion of the compound onto the cooking device.

The prior art automatic fire extinguishing devices have the disadvantage of requiring a significant amount of time for installation, and significant expense over and above that typically required to install the stove itself. This is due to the elaborate piping required to transport the fire extinguishing compound from the storage container to the spraying device. Moreover, the prior art automatic fire extinguishing devices also have the drawback that as the distance between the storage container and the spraying device (e.g. nozzles) is increased, a greater force is required to project the fire extinguishing compound. Therefore, a larger storage container and supply of fire extinguishing compound are needed.

The prior art storage container and piping are typically not aesthetically appealing and tend to detract from a kitchen's appearance. In addition to the unsightly appearance of the storage container and the piping, the spray device (i.e., nozzle) which projects the fire extinguishing compound typically extends downward from the range hood to better direct the fire extinguishing compound. The spray device generally detracts from the appearance of the kitchen and interferes with the use of the stove top.

The prior art automatic fire extinguishing device has the further drawback that it must also have a fire sensing mechanism operatively positioned to determine the existence of a fire. The fire sensing mechanism must be located proximate the cooking surface. The fire sensing mechanism, like the spray device, is readily visible and detracts from the kitchen's appearance.

There is thus a need for a fire extinguishing device which is unobtrusive, generally pleasing in appearance, relatively lightweight and streamlined, self-contained, and does not require a substantial amount of time and money to install.

OBJECTS AND SUMMARY OF THE INVENTION

It is accordingly an object of the present invention to provide an automatic fire extinguishing device for a cooking appliance which is compact and self-contained.

It is another object of the present invention to provide an automatic fire extinguishing device in which the fire extinguisher container, triggering mechanism and nozzles present no hindrance to the operation of the cooking appliance.

It is yet another object of the present invention to provide an automatic fire extinguishing device which does not require an extensive amount of time and expense for installation.

It is a further object of the present invention to provide an automatic fire extinguishing device which overcomes inherent disadvantages of known automatic fire extinguishing devices.

In accordance with one form of the present invention, a self-contained automatic fire extinguishing device includes a container having container walls defining a container chamber for storage of a fire extinguishing agent therein. The container has at least one aperture through its container walls. The fire extinguishing device also includes a vessel having vessel walls defining a vessel chamber. The vessel, which has at least one bore therethrough, is coupled to the container such that the container chamber is in fluid communication with the vessel chamber via the at least one aperture of the container. The fire extinguishing device also includes a closure/actuating element coupled to the container for substantially selectably sealing the at least one aperture of the container to alternately prevent and permit fluid communication between the container chamber and the vessel chamber.

In accordance with another form of the present invention, an automatic fire extinguishing system for a cooking device having a top cooking area includes a range hood mountable proximate the cooking device and an automatic fire extinguishing device adapted to be coupled to the range hood. The automatic fire extinguishing device includes a container having container walls defining a first container chamber for storage of a fire extinguishing agent wherein the container walls have at least one aperture therethrough. The automatic fire extinguishing device also includes a vessel having vessel walls defining a vessel chamber wherein the vessel walls have at least one bore therethrough. The vessel is coupled to the container such that the container chamber is in fluid communication with the container chamber via the at least one aperture. The automatic fire extinguishing system also includes a closure/actuating component substantially selectably sealing the at least one aperture of the container to alternately prevent and permit fluid communication between the container chamber and the vessel chamber.

In another form of the present invention, an automatic fire extinguishing apparatus includes a first container adapted to the mounted proximate an area to be protected. The first container includes first container walls defining a first container chamber adapted to contain a fire extinguishing agent at a pressure at least equal to an ambient pressure. The container walls have at least one aperture therethrough adapted to release the fire extinguishing agent from the first container chamber. The fire extinguishing apparatus also includes a second container having second container walls defining a second container chamber. The second container being operatively coupled to the first container such that the second container chamber is in fluid communication with the first container chamber via the at least one aperture. The second container includes at least one distribution slot for dispersing the fire extinguishing agent provided from the first container. The fire extinguishing apparatus also includes a bi-metal release element removably coupled about the at least one aperture. The bi-metal release element retains the fire extinguishing agent within the first container, and is adapted to be decoupled from the at least one aperture when a predetermined temperature above an ambient temperature is provided. When the predetermined temperature above ambient temperature is reached, the bi-metal release element decouples from the at least one aperture. This action provides fluid communication between the first container chamber and the second container chamber such that at least a portion of the fire extinguishing agent is provided from the first container chamber to the second container chamber via the at least one aperture. As a result, at least a portion of the fire extinguishing agent is provided from the second container chamber to the area to be protected by the at least one distribution slot.

A preferred form of the self-contained automatic fire extinguisher, as well as other embodiments, objects, features and advantages of this invention, will be apparent from the following detailed description of illustrative embodiments thereof, which is to be read in connection with the accompanying drawings.

DETAILED DESCRIPTION OF THE PREFERRED EMBODIMENTS

Figure 1:
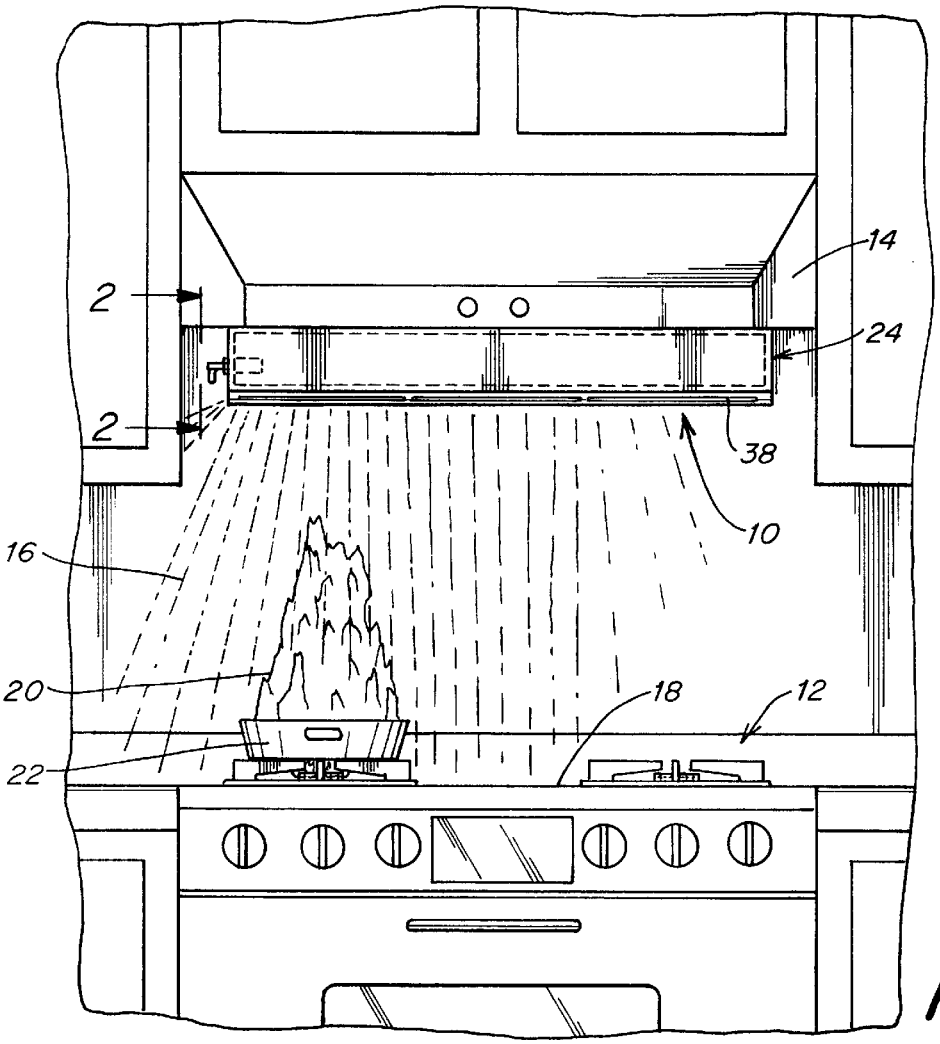
FIG. 1 is a perspective view of an automatic fire extinguisher of the present invention in use, wherein the fire extinguisher is contained within a range hood above a stove.

Referring now to the drawings, a self-contained automatic fire extinguisher 10 is shown. The fire extinguishing device of the present invention is designed to be placed above or proximate an area having an increased risk of fire such as a kitchen stove 12, a home heating unit (not shown) and the like.

Referring now to FIG. 1, the self-contained automatic fire extinguisher 10 is shown mounted within a range hood 14 of the stove 12. For ease in viewing the fire extinguisher 10, the bottom portion of the front cover of the range hood is not shown in FIG. 1. The automatic fire extinguisher is shown expelling a fire extinguishing agent 16 onto the top surface 18 of the kitchen stove 12 in order to extinguish a fire 20 present, for example, in pan 22. A wide variety of fire suppression and fire extinguishing compounds may be used as the fire extinguishing agent. A preferred fire extinguishing agent is PURPLE K™ powder which is a potassium bicarbonate base dry chemical fire extinguishing agent. In addition, suitable fire extinguishing agents for use in the present invention are disclosed in U.S. Pat. No. 4,756,839 (Curzon et al), the disclosure of which is incorporated herein by reference.

Figure 2:
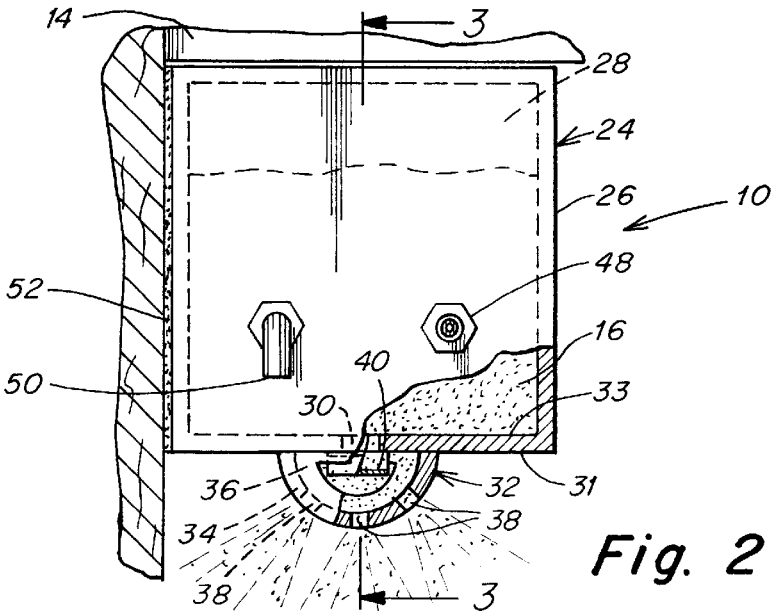
FIG. 2 is a left end view of the automatic fire extinguisher of the present invention as seen along lines 2—2 of FIG. 1.
Figure 3:
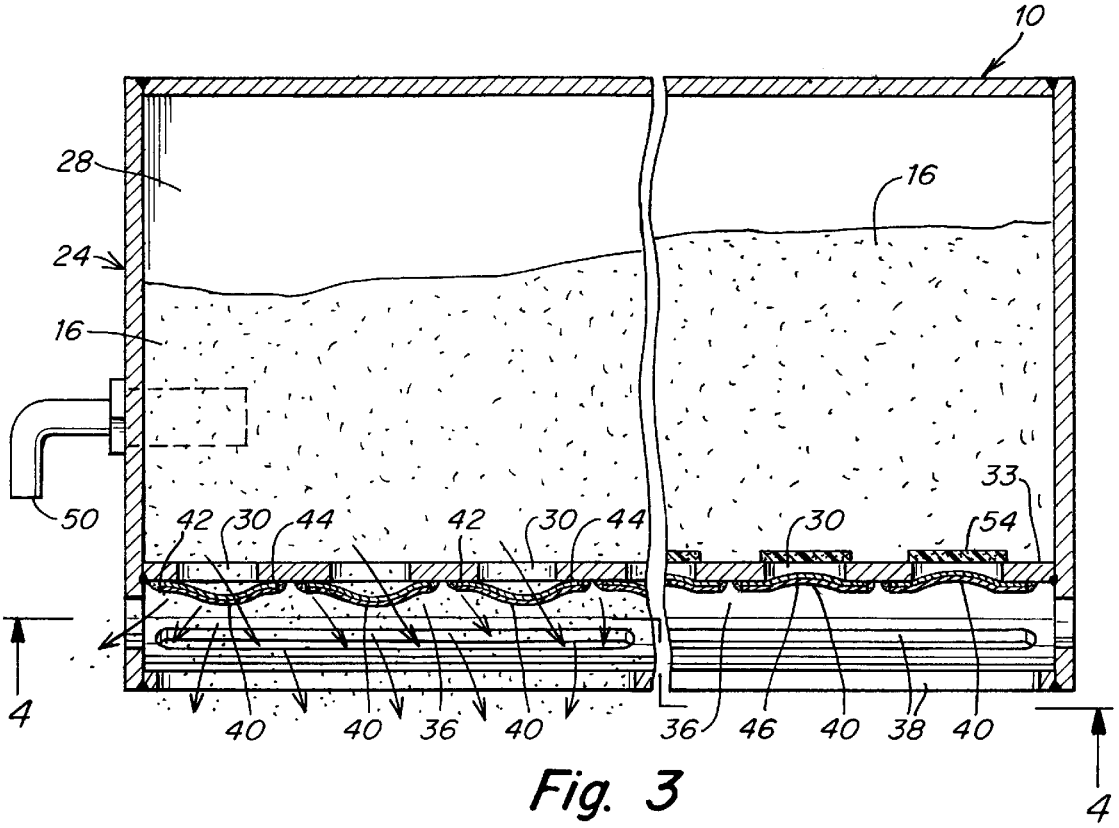
FIG. 3 is a cross-sectional view of the automatic fire extinguisher of the present invention as seen along lines 3—3 of FIG. 2 wherein fire extinguishing agent is being released from a portion of the automatic fire extinguisher.
Figure 4:
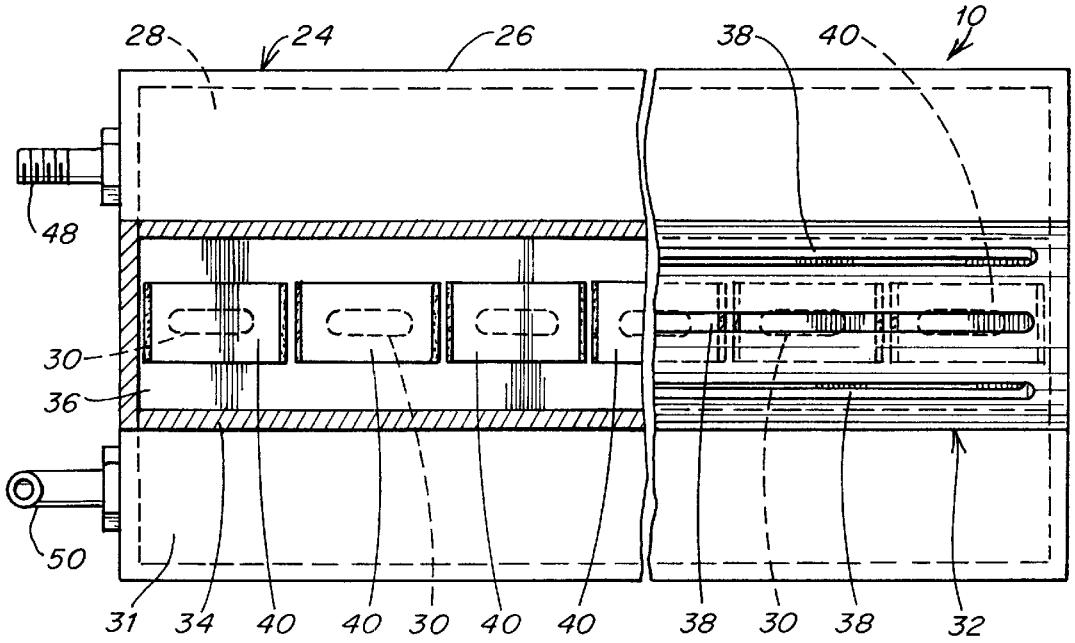
FIG. 4 is a bottom plan view and partial cross-sectional view of the automatic fire extinguisher of the present invention as seen along lines 4—4 of FIG. 3.
Figure 5:
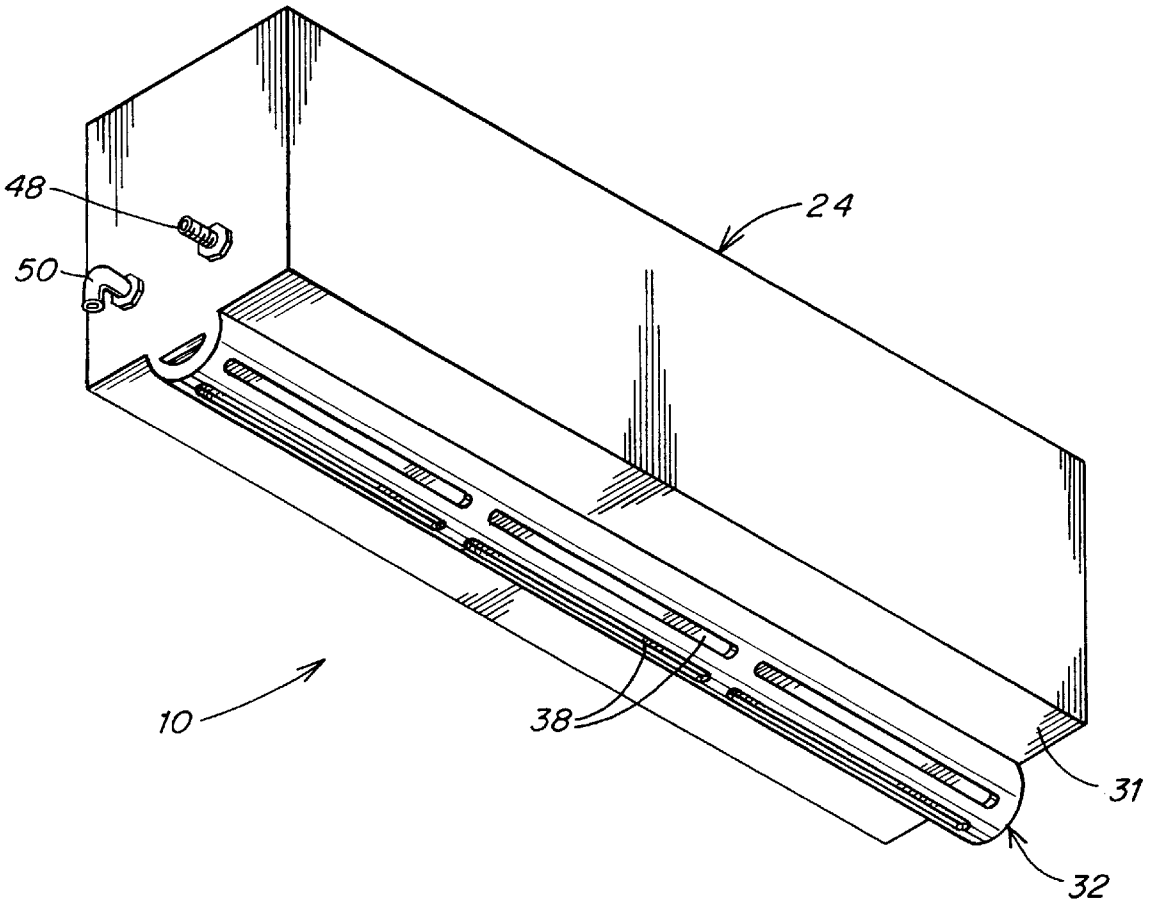
FIG. 5 is a bottom perspective view of the automatic fire extinguisher of the present invention.

Referring now to FIGS. 2 and 4, the fire extinguisher 10 includes a container 24 having container walls 26 which define a container chamber 28. The container chamber stores the fire extinguishing agent 16 and air therein. The container may be of any shape. However, in the preferred embodiment, at least one side of the container 24 (preferably the side opposite the portion of the container which will expel the fire extinguishing agent) is substantially planar so that the container can be easily mounted to a planar mounting surface such as an interior portion of range hood 14. The container 24 also includes a series of apertures (i.e. slots) 30 (FIGS. 2, 3 and 4) along and through one side 31 of the container. The apertures 30 serve to provide fluid communication between the container chamber 28 and vessel chamber 36 as will be described in detail below.

The automatic fire extinguishing device also includes a vessel 32 having vessel walls 34 defining a vessel chamber 36. The vessel may have any shape. In the preferred embodiment, the vessel is semi-cylindrical and its cross-section is semicircular (as shown in FIG. 2). One of the vessel walls 34 is preferably coupled to side 31 of the container 24 such that the apertures 30 formed through container wall 31 are in selectable fluid communication with the vessel chamber 36. Therefore, fire extinguishing agent 16 may be provided from the container chamber 28 to the vessel chamber 36 via the apertures 30. The vessel 32 also includes a plurality of openings 38 (hereinafter referred to as "distribution slots") formed through the vessel walls 34 such that there is fluid communication between the vessel chamber 36 and areas external to (i.e., proximate) the fire extinguishing device 10.

The container 24 and vessel 32 may be made of a variety of metal and plastic materials such as, for example, sheet metal, fiberglass and fluoropolymers. However, it is preferred that the container and vessel be made of a moldable non-combustible plastic such as BAKELITE™. BAKELITE™ is preferred because of its ease in manufacture, its ability to provide a lightweight device and due to the material's inherent strength to withstand internal pressure differentials and relatively high temperatures (approximately 500°–800° F.).

Referring now to FIGS. 3 and 4, the fire extinguishing device 10 also includes a plurality of heat responsive closure/actuating elements 40. The closure/actuating elements 40 are preferably coupled to side 31 of the container 24 so as to substantially fluidly seal (i.e., block) the apertures 30 formed through the container wall 26. While a plurality of heat responsive closure/actuating elements 40 are shown in the drawings, one over each of the apertures 30 of the container, it is foreseen that one closure/actuating element which seals all of the apertures 30 may be employed. In a preferred embodiment, the closure/actuating elements 40 are coupled to a surface of side 31 of the container which is external to the container chamber 28. However, it is foreseen that the closure/actuating elements 40 may be coupled to an interior surface 33 (FIGS. 2 and 4) of side 31 which is within container 24.

The closure/actuating element 40 is preferably a bi-metal release element. As shown in FIG. 3, each bi-metal release element 40 is preferably connected at two opposing sides 42, 44 of the element 40 so as to cover or block the corresponding aperture 30. The bi-metal release element 40 is preferably cupped and designed to move in a snap action toward a reverse cup shape at one temperature (see left side of FIG. 3), for example, 135° F., and when in the reversed shape, to return to its original shape (see right side of FIG. 3) at a second, lower temperature, for example 100° F. Furthermore, the bi-metal release element 40 is positioned with its concave surface 46 facing vessel 32 (see right side of FIG. 3), such that the bi-metal release element is urged against the surfaces of the wall surrounding apertures 30 to resiliently maintain the apertures 30 in a fluidly sealed and closed position. The operation and attachment of the bi-metal release element may be of the type described in U.S. Pat. No. 5,441,113, the entire disclosure of which is incorporated herein by reference. It is foreseen that in order to more effectively prevent fluid communication between the container chamber 28 and the vessel 32, apertures 30 may include an insert (for example, a rubber insert) which will enable a better seal with the bi-metal release element.

In the event of a fire, the temperature surrounding the fire extinguishing device 10 and the bi-metal release element 40 will rise. As the bi-metal release element 40 reaches its operating temperature (for example, between 135° F. and 185° F.), the element snaps from a cup-shape (right side of FIG. 3) to a reverse cup shape (left side of FIG. 3), permitting fluid communication between the container chamber 28 and the vessel chamber 36. The elevated temperature from the fire also causes an increase in the pressure of the fire extinguishing agent 16 located within the container chamber 28. When the bi-metal release element 40 snaps to a reverse cup shape (left side in FIG. 3), fire extinguishing agent 16 is immediately discharged from the container chamber 28 through the apertures 30. Due to the force with which the fire extinguishing agent is provided through the apertures 30, the fire extinguishing agent 16 is expelled from the vessel chamber 36 through distribution slots 38 of the vessel 32. The distribution slots 38 are positioned such that a wide dispersion of the fire extinguishing agent 16 is provided over the surface of the range top. The exact positioning of the distribution slots 38 is dependent upon the height at which the fire extinguisher is maintained above the cooking surface and the size of the area to be protected. It is generally suitable to have three (3) groups of distribution slots which are substantially equally radially dispersed as shown in FIG. 2. This arrangement provides a wide dispersion of the fire extinguishing agent over the surface of the stove. Alternately, the distribution slots can be configured to provide a narrow application of the fire extinguishing compound.

After the fire is extinguished by the fire extinguishing agent 16, the bi-metal release element 40 cools and, upon reaching its lower operating temperature, returns to its original position to fluidly seal the aperture 30 of container 24 to substantially prevent fluid communication between container chamber 28 and vessel chamber 36 (see right side of FIG. 3).

In the preferred embodiment of the invention, the automatic fire extinguishing device 10 includes a refill valve 48 (FIGS. 2 and 4) operatively coupled to the container 24. The refill valve 48 is in selective fluid communication with the container chamber 28 to permit introduction of fire extinguishing agent 16 within the container chamber. The refill valve 48 may be of any type suitable for providing the fire extinguishing agent 16 into the container and for preventing release of the agent (in a reverse direction) through the valve.

In the preferred embodiment of the invention, the fire extinguishing device 10 includes a pressure release valve 50 operatively connected to the container 24. The pressure release valve 50 is in fluid communication with the interior of container chamber 28. The pressure release valve 50 is included as a safety device to release at least a portion of the fire extinguishing agent 16 and gases within the chamber 28 to reduce a pressure build up in the chamber 28 when the bi-metal release elements 40 have not been activated. Such a condition might occur during a refill process wherein a greater amount of fire extinguisher agent is provided to the container chamber then recommended. The pressure relief valve 50 is preferably selected such that during normal operating conditions in the presence of a fire, the pressure relief valve 50 will not activate and reduce the pressure within the container chamber before the bi-metal release elements 40 are activated.

The present invention is designed such that the fire extinguishing agent 16 may be stored within the container chamber 28 at a pressure which is above ambient pressure in order to disperse the fire extinguishing agent 16 with force. It is also foreseen that the fire extinguisher agent may be stored in the container chamber 28 at an ambient pressure. It is foreseen that the heat from a fire will heat the container 24 and the fire extinguishing agent 16 and air present therein. The transfer of heat energy through the container wall 26 increases the pressure within the container chamber 28. It is foreseen that when exposed to the heat of a fire, the pressure within the chamber 28 may rise up to about 5 times that of ambient pressure. This elevated pressure is substantially adequate to disperse the fire extinguisher agent 16 from the container chamber 28 through the vessel 32 and out of the distribution slots 38 to extinguish a fire 20. Even if a relatively low pressure is attained within the container chamber 28, if the fire extinguishing device 10 is positioned above fire, the activation of the bi-metal release element 40 will permit the fire extinguishing agent 16 to fall to the surface below by means of gravity.

The automatic fire extinguishing device of the present invention also includes means 52 (see FIG. 2) for mounting the fire extinguisher proximate a cooking area. The mounting means may be any method including, but not limited to, adhesive tape or glue, and a slot configuration coupled to the container for coupling to nails or screws extending from a surface to which the fire extinguishing device is to be attached.

In an alternative embodiment of the invention, the heat responsive closure/actuating elements 40 may include thinly rolled foil (approximately 1/20,000 for an inch) made of indium which, when exposed to an elevated temperature, will melt thereby releasing the fire extinguishing agent. Since the indium foil melts at an elevated temperature and does not return to its original form as does the bi-metal release element, the device is therefore not designed for reuse. In yet another embodiment, the heat responsive closure/actuating elements 40 may include a plastic which melts at a temperature indicative of a fire (i.e., about 135° F.).

In the preferred embodiment of the present invention, foam insulator strips 54 (right side of FIG. 3) are coupled to the interior surface 33 of container 24 to cover (i.e. seal) each aperture 30. The foam insulator strips 54 provide a barrier between the fire extinguishing agent 16 and the heat responsive closure/actuating elements 40 in order to prevent the fire extinguishing agent 16 from coming into direct contact with the elements 40. This configuration permits the elements 40 to increase in temperature as a result of their proximity to a fire without having the agent 16 absorb heat energy from the elements 40. In the preferred embodiment, the foam insulator strips 54 are designed to melt at a temperature which is coincident with the melting/actuation of the heat responsive closure/actuating elements 40 such that when the elements 40 are actuated, the agent 16 will be expelled from the vessel 32.

In operation, the self-contained automatic fire extinguisher 10 is hung proximate to stove 12. Preferably, the vessel portion 32 of the fire extinguisher 10 is positioned in a substantially downward orientation while the fire extinguisher is placed directly above the cooking device.

When a fire 20 develops in a pan 22 as shown in FIG. 1, heat energy released by the fire 20 raises the temperature of the area proximate the stove and especially the area above the stove. As a result of the increased air temperature, heat energy is transmitted through the container walls to the fire extinguisher agent 16 located in the container chamber 28. The transfer of energy causes the pressure within the container 24 to increase above that initially present in the container.

In addition to the increase in pressure within the container chamber, the elevated temperature provided as a result of the fire causes the temperature of the bi-metal release elements 40 to increase. As the bi-metal release elements 40 reach their operating temperature, the elements 40 snap to a reverse cup shape and the foam insulator strips disintegrate. This provides fluid communication between the container chamber 28 and the vessel chamber 36 via the apertures 30. Once fluid communication is established between the container chamber 28 and the vessel chamber 36, the increased pressure within the container propels the fire extinguishing agent through the apertures 30. The expulsion pressure of the fire extinguishing agent 16 causes the agent to traverse through and out of the vessel 32 via the distribution slots 38. The distribution slots 38 are positioned so as to disperse the extinguishing agent 16 over the entire cooking surface.

Once the fire has been extinguished, the temperature surrounding the self-contained automatic fire extinguishing device 10 will decrease, causing the bi-metal release elements 40 to cool. Upon reaching their lower operating temperature, the bi-metal release elements 40 will return to their original position blocking or sealing openings 30 and substantially eliminating fluid communication between the container chamber 28 and the vessel chamber 36. Once the foam insulator strips are replaced, the extinguisher 10 can be reused by refilling the container chamber with fire extinguishing agent 16 through the refill valve 48.

As a result of the present invention, a compact self-contained, automatic fire extinguisher is provided. From the foregoing description, it will be seen that the present invention provides a useful system for extinguishing fires on cooking surfaces and the like.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed:

1. An automatic fire extinguishing device comprising:

a container having container walls defining a container chamber for storage of fire extinguishing agent therein, said container walls having at least one aperture therethrough;

a vessel having vessel walls defining a vessel chamber, said vessel walls having at least one opening therethrough, said vessel being coupled to said container such that said container chamber is in fluid communication with said vessel chamber via said at least one aperture; and a heat responsive closure/actuating element selectively sealing said at least one aperture of said container to prevent fluid communication between said container chamber and said vessel chamber;

wherein said closure/actuating element comprises a bimetal release device.

2. The automatic fire extinguishing device comprising:

a container having container walls defining a container chamber for storage of fire extinguishing agent therein, said container walls having at least one aperture therethrough;

a vessel having vessel walls defining a vessel chamber, said vessel walls having at least one opening therethrough, said vessel being coupled to said container such that said container chamber is in fluid communication with said vessel chamber via said at least one aperture; and a heat responsive closure/actuating element selectively sealing said at least one aperture of said container to prevent fluid communication between said container chamber and said vessel chamber;

wherein said fire extinguishing agent is maintained in said container at substantially ambient pressure.

3. The automatic fire extinguishing device comprising:

a container having container walls defining a container chamber for storage of fire extinguishing agent therein, said container walls having at least one aperture therethrough;

a vessel having vessel walls defining a vessel chamber, said vessel walls having at least one opening therethrough, said vessel being coupled to said container such that said container chamber is in fluid communication with said vessel chamber via said at least one aperture;

a heat responsive closure/actuating element selectively sealing said at least one aperture of said container to prevent fluid communication between said container chamber and said vessel chamber; and a pressure release valve operatively connected to said container, said pressure release valve being in fluid communication with said container chamber to permit expulsion of at least a portion of said fire extinguishing agent from said container chamber when a pressure within said container chamber exceeds a predetermined threshold.

4. The automatic fire extinguishing device comprising:

a container having container walls defining a container chamber for storage of fire extinguishing agent therein, said container walls having at least one aperture therethrough;

a vessel having vessel walls defining a vessel chamber, said vessel walls having at least one opening therethrough, said vessel being coupled to said container such that said container chamber is in fluid communication with said vessel chamber via said at least one aperture;

a heat responsive closure/actuating element selectively sealing said at least one aperture of said container to prevent fluid communication between said container chamber and said vessel chamber;

wherein when said closure/actuating element is exposed to a temperature above a predetermined threshold temperature, said closure/actuating element permits fluid communication between said container chamber and said vessel chamber such that said fire extinguishing agent traverses through said at least one aperture and is Provided to said vessel chamber; and wherein the predetermined threshold temperature is approximately 135°–155° F.

5. The automatic fire extinguishing device comprising:

a container having container walls defining a container chamber for storage of fire extinguishing agent therein, said container walls having at least one aperture therethrough;

a vessel having vessel walls defining a vessel chamber, said vessel walls having at least one opening therethrough, said vessel being coupled to said container such that said container chamber is in fluid communication with said vessel chamber via said at least one aperture; and a heat responsive closure/actuating element selectively sealing said at least one aperture of said container to prevent fluid communication between said container chamber and said vessel chamber;

wherein said at least one aperture comprises a plurality of slots.

6. The automatic fire extinguishing device comprising:

a container having container walls defining a container chamber for storage of fire extinguishing agent therein, said container walls having at least one aperture therethrough;

a vessel having vessel walls defining a vessel chamber, said vessel walls having at least one opening therethrough, said vessel being coupled to said container such that said container chamber is in fluid communication with said vessel chamber via said at least one aperture; and a heat responsive closure/actuating element selectively sealing said at least one aperture of said container to prevent fluid communication between said container chamber and said vessel chamber;

wherein the at least one opening comprises a plurality of distribution slots.

7. The automatic fire extinguishing device comprising:

a container having container walls defining a container chamber for storage of fire extinguishing agent therein, said container walls having at least one aperture therethrough;

a vessel having vessel walls defining a vessel chamber, said vessel walls having at least one opening therethrough, said vessel being coupled to said container such that said container chamber is in fluid communication with said vessel chamber via said at least one aperture; and a heat responsive closure/actuating element selectively sealing said at least one aperture of said container to prevent fluid communication between said container chamber and said vessel chamber;

wherein said vessel has a substantially semi-cylindrical shape, and wherein said vessel substantially encloses the at least one aperture of the first container.

8. The automatic fire extinguishing device comprising:

a container having container walls defining a container chamber for storage of fire extinguishing agent therein, said container walls having at least one aperture therethrough;

a vessel having vessel walls defining a vessel chamber, said vessel walls having at least one opening therethrough, said vessel being coupled to said container such that said container chamber is in fluid communication with said vessel chamber via said at least one aperture;

a heat responsive closure/actuating element selectively sealing said at least one aperture of said container to prevent fluid communication between said container chamber and said vessel chamber; and means for mounting the automatic fire extinguishing device proximate a cooking area.

9. The automatic fire extinguishing device comprising:

a container having container walls defining a container chamber for storage of fire extinguishing agent therein, said container walls having at least one aperture therethrough;

a vessel having vessel walls defining a vessel chamber, said vessel walls having at least one opening therethrough, said vessel being coupled to said container such that said container chamber is in fluid communication with said vessel chamber via said at least one aperture; and a heat responsive closure/actuating element selectively sealing said at least one aperture of said container to prevent fluid communication between said container chamber and said vessel chamber;

wherein a pressure inside said first container is increased when the automatic fire extinguishing device is exposed to an elevated temperature.

10. The automatic fire extinguishing device comprising:

a container having container walls defining a container chamber for storage of fire extinguishing agent therein, said container walls having at least one aperture therethrough;

a vessel having vessel walls defining a vessel chamber, said vessel walls having at least one opening therethrough, said vessel being coupled to said container such that said container chamber is in fluid communication with said vessel chamber via said at least one aperture;

a heat responsive closure/actuating element selectively sealing said at least one aperture of said container to prevent fluid communication between said container chamber and said vessel chamber; and a discharge release component substantially removably coupled to said at least one aperture of said vessel, the discharge release component selectively fluidly sealing and unsealing said at least one bore, the discharge release component being substantially decoupled from said vessel when said extinguishing compound is expelled from the automatic fire extinguishing device.

11. An automatic fire extinguishing system for a cooking device having a top cooking area comprising:

a) a range hood mountable proximate said cooking device;

b) an automatic fire extinguishing device adapted to be coupled to said range hood comprising:

a container having container walls defining a first container chamber for storage of a fire extinguishing agent, said container walls having at least one aperture therethrough;

a vessel having vessel walls defining a vessel chamber, said vessel walls having at least one bore therethrough, said vessel being coupled to said container such that said container chamber is in selectable fluid communication with said container chamber via said at least one aperture;

a heat responsive closure/actuating element interposed across said at least one aperture of said container to substantially seal said at least one aperture of said container to selectably prevent and permit fluid communication between said container chamber and said vessel chamber.

12. An automatic fire extinguishing apparatus, comprising;

a first container adapted to be mounted proximate an area to be protected, said first container having first container walls defining a first container chamber adapted to contain a fire extinguishing agent at a pressure at least equal to ambient pressure, said container walls having at least one aperture therethrough adapted to release the fire extinguishing agent from said first container chamber;

a second container having second container walls defining a second container chamber, the second container being operatively coupled to said first container such that said second container chamber is in fluid communication with said first container chamber via said at least one aperture, said second container having at least one distribution slot for dispersing said fire extinguishing agent provided from said first container;

a bi-metal release element removably coupled about said at least one aperture, said bi-metal release element retaining said extinguishing agent within said first container, said bi-metal release element being adapted to be decoupled from said at least one aperture when a predetermined temperature above an ambient temperature is provided;

wherein when the predetermined temperature above said ambient temperature is reached, the bi-metal release element decoupling from said at least one aperture to permit fluid communication between said first container chamber and said second container chamber such that at least a portion of said fire extinguishing agent is provided from said first container chamber to said second container chamber via said at least one aperture, and wherein at least a portion of said fire extinguishing agent is provided from said second container via to said area to be protected via said at least one distribution slot.

13. An automatic fire extinguishing device comprising:

a container having container walls defining a container chamber for storage of fire extinguishing agent therein, said container walls having at least one aperture therethrough;

a vessel having vessel walls defining a vessel chamber, said vessel walls having at least one opening therethrough, said vessel being coupled to said container such that said container chamber is in fluid communication with said vessel chamber via said at least one aperture;

a heat responsive closure/actuating element substantially selectably sealing said at least one aperture of said container to alternately prevent and permit fluid communication between said container chamber and said vessel chamber responsive to heat;

wherein said at least one aperture comprises a plurality of slots.

14. An automatic fire extinguishing device comprising:

a container having container walls defining a container chamber for storage of fire extinguishing agent therein, said container walls having at least one aperture therethrough;

a vessel having vessel walls defining a vessel chamber, said vessel walls having at least one opening therethrough, said vessel being coupled to said container such that said container chamber is in fluid communication with said vessel chamber via said at least one aperture;

a heat responsive closure/actuating element substantially selectably sealing said at least one aperture of said container to alternately prevent and permit fluid communication between said container chamber and said vessel chamber responsive to heat;

wherein said vessel has a substantially semi-cylindrical shape, and wherein said vessel substantially encloses the at least one aperture of the first container.

* * * * *